United States Patent [19]

Hillers et al.

[11] 4,385,391

[45] May 24, 1983

[54] MECHANISM FOR OPENING ELECTRODE HOLDERS OF ELECTRIC SMELTING FURNACES

[75] Inventors: Franz-Josef Hillers; Heinz Berentsen, both of Oberhausen; Norbert Jäger, Duisburg, all of Fed. Rep. of Germany

[73] Assignee: M.A.N. Maschinenfabrik Augsburg-Nürnberg Aktiengesellschaft, Fed. Rep. of Germany

[21] Appl. No.: 246,018

[22] Filed: Mar. 20, 1981

[30] Foreign Application Priority Data

Mar. 21, 1980 [DE] Fed. Rep. of Germany ..... 3010894

[51] Int. Cl.[3] ..... H05B 7/103

[52] U.S. Cl. ..... 373/99

[58] Field of Search ..... 373/94, 98, 99, 100, 373/101

[56] References Cited

U.S. PATENT DOCUMENTS

| | | | |
|---|---|---|---|
| 2,148,834 | 2/1939 | Payne | 373/99 |
| 2,538,603 | 1/1951 | Thys | 373/99 |
| 2,623,080 | 12/1952 | Young | 373/99 |
| 3,444,305 | 5/1969 | Turner | 373/99 |
| 4,182,927 | 1/1980 | Phillips | 373/99 |

*Primary Examiner*—Roy N. Envall, Jr.

*Attorney, Agent, or Firm*—McGlew and Tuttle

[57] ABSTRACT

An electrode holder is disclosed particularly for smelting furnaces which comprises an electrode arm, a fixed contact to the arm and a movable contact movably mounted to the arm. A biasing spring is connected in the mounting of the movable contact on the electrode arm to bias the movable contact toward the fixed contact to hold an electrode between the two contacts. A fluid pressure cylinder is provided in the electrode arm which acts on the movable contact to counteract the force of the spring to release the electrode from between the contacts. The fluid pressure cylinder is supplied by a fluid motor, fluid pump and fluid reservoir combination which is mounted as a constructional unit within the electrode arm. The fluid may be hydraulic or pneumatic. Electrical power is supplied to the motor by an electric line and air is supplied to a compartment containing the motor pump and reservoir combination. Flexible pressure fluid lines are therefore not required.

11 Claims, 2 Drawing Figures

MECHANISM FOR OPENING ELECTRODE HOLDERS OF ELECTRIC SMELTING FURNACES

FIELD AND BACKGROUND OF THE INVENTION

The present invention relates in general to electrode holders and in particular to a new and useful electrode holder, particularly for smelting furnaces, which includes a clamping jaw opening device having all components positioned within an electrode arm of the electrode holder.

Electric smelting furnaces are supplied with electric power through high-amperage cables and conductor tubes of copper which are secured to water-cooled electrode arms movable in a vertical plane and connected to fixed contact jaws of water-cooled electrode holders which are provided on a front face of the electrode arms. To minimize the contact resistance between the graphite electrode and the mating contact surface of the contact jaw, a clamping jaw is provided in the electrode holder opposite the contact jaw, by which the electrode is firmly pressed into contact and held in place. The contact pressure is produced by a pretensioned spring and transmitted through levers or a linkage to the electrode holder.

To insert the graphite electrode into the electrode holder, or if a displacement of the electrode is necessary, the spring force acting on the clamping jaw is removed and, by enlarging the inside diameter of the electrode holder, the holder is disengaged from the graphite electrode. The contact pressure is removed by means of a pneumatic or hydraulic cylinder whose piston, upon being supplied with the pressure fluid, causes compression of the spring and displacement of the clamping mechanism of the electrode holder in the "opening" direction. Upon inserting or displacing the electrode, the fluid pressure is removed and the spring force again provides for a secure contact pressure and fixing of the electrode in the electrode holder.

In prior art electric furnaces, the mechanism for clamping and opening is mounted outside the electrode arm (see German Pat. No. 847,319 which is here incorporated by reference). It was also provided to dispose the clamping spring within the electrode arm (German Pat. No. 946,303 also incorporated by reference). A hydraulically operated cylinder for removing the contact pressure has the advantage over a pneumatically operated one that it is of smaller size. The pressure fluid is supplied into a hydraulic or pneumatic cylinder through flexible pressure tubes which are connected to the respective supply unit on the furnace floor.

The mentioned installations have the disadvantage that they are not protected against the hot atmosphere developing above the furnace, nor against the magnetic fields of the power supply to the furnace, and particularly that the flexible tubes supplying the operating fluid, whose length must correspond to the range of displacement of the electrode arm, are subjected to high mechanical stresses and therefore, may cause considerable trouble in operation and even accidents. Especially if hydraulic oil is used as the operating fluid, leakage at defective locations increases the fire hazard.

SUMMARY OF THE INVENTION

The present invention is directed to a mechanism for opening the clamping jaws of an electrode holder of the above mentioned kind, which has a compact arrangement, and wherein the individual constructional parts are protected against ambient conditions and, with the exception of flexible cables for electric power supply, no flexible supply tubes for a pressure fluid are needed.

Accordingly an object of the present invention is to provide the electrode holder comprising, an electrode arm, a fixed contact to an end of the arm, a movable electrode jaw movably mounted to the arm and having a clamping contact, biasing spring means for moving the clamping jaw toward the fixed contact to clamp an electrode between the fixed and clamping contacts, fluid pressure means in the arm which is connected to the electrode jaw for acting to counter the force of the biasing spring means when fluid under pressure is supplied to the biasing pressure means, and fluid motor means in the arm and connected to the fluid pressure means for supplying the fluid under pressure to the fluid pressure means.

The interior of the electrode arm is particularly suitable for accommodating the complete jaw opening mechanism, since the outer casing is double-walled and cooling fluid is circulated therethrough, so that the inside temperature is almost constant. If a hydraulic cylinder is used as the fluid pressure means for opening the electrode holder, the complete fluid motor means or hydraulic set for producing the fluid pressure operating the hydraulic cylinder and including a supply tank, an electric motor, a pump, controls, and flexible connecting tubes, is accommodated within the electrode arm. If a pneumatic cylinder is used instead, the complete pneumatic set for producing the necessary pressure and including an electric motor, a compressor, a pressure tank, controls, and flexible connecting tubes, is accommodated within the electrode arm. The hydraulic or pneumatic set is designed for being mounted and dismounted as a compact unit.

This results in the advantage that no long flexible supply tubes for the pressure fluid is needed, only power supply cables are needed. Air for the motor or compressor is supplied through a correspondingly dimensioned tube also accommodating the power cable. Another advantage is that the clamping and opening mechanism is completely protected against effects from the ambience, such as heat or damages. To eliminate undesirable oscillations in the movable electrode arm, it is provided that the hydraulic or pneumatic set is mounted in an electrode arm compartment lined with a non-magnetic and dielectric material, on elastic mounting members which provide insulation and absorb vibrations. Disturbing shocks and the influence of the magnetic fields of the power supply are thereby eliminated to a large extent.

Another object of the invention therefore is to provide an electrode holder which includes, as the fluid pressure means, a cylinder-piston combination connected to the movable clamping or electrode jaw, the fluid motor means comprising a reservoir for the fluid, a motor and pump combination for supplying the fluid from the reservoir to the cylinder-piston combination and mounting means for mounting the reservoir and motor pump combination, elastically and in an insulated manner to the interior of the electrode arm.

A further object of the invention is to provide an electrode holder which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
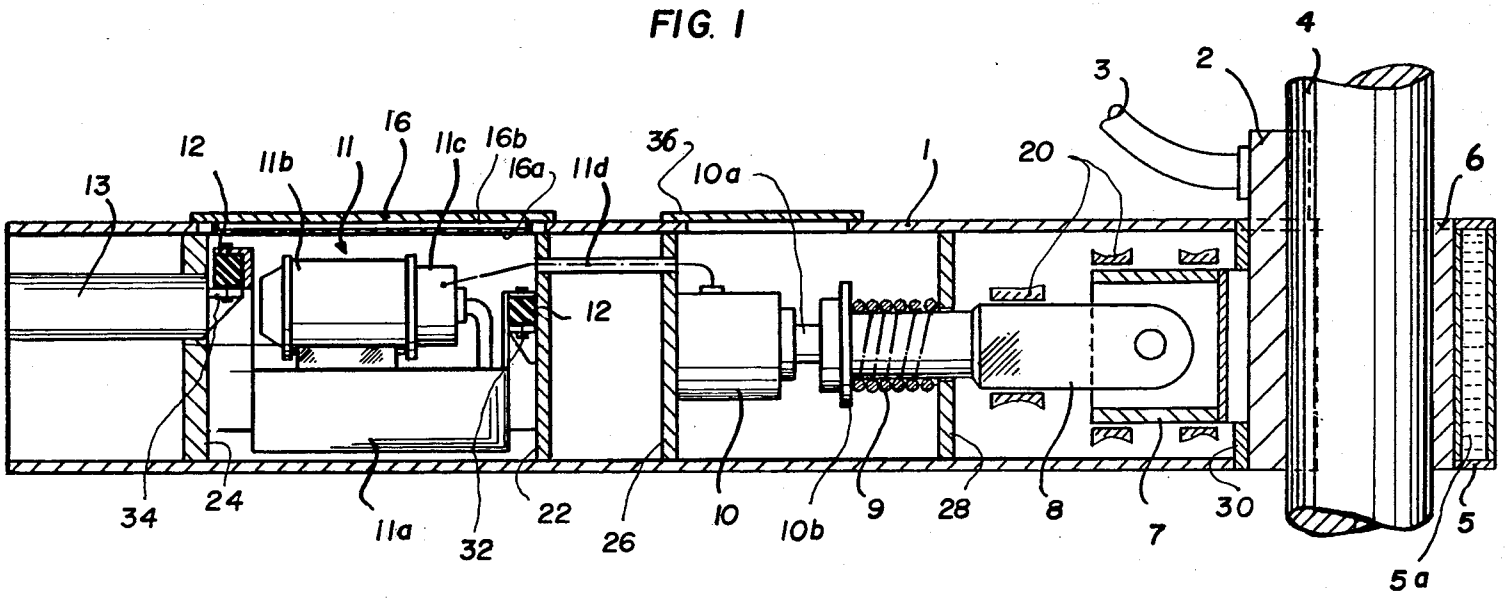
FIG. 1 is a side sectional view of an electrode arm with a hydraulically operated clamping and unclamping mechanism mounted therein, according to the invention.

Turning to the drawings in particular, the invention embodied therein comprises, an electrode arm 1 having a fixed contact 2 connects to one end of the arm, a movable electrode or clamping jaw 5 movably mounted to the electrode arm and carrying a clamping contact 6, biasing spring means, for example spring 9, for moving the clamping jaws 5 into fixed contact to clamp an electrode 4 between the fixed contact and the movable contact 6, pressure fluid means such as a piston-cylinder combination 14 connected to the clamping jaw 5 for countering the action of spring 9 when supplied with hydraulic fluid, and fluid motor means generally designated 15 for supplying such fluid to the fluid pressure means 14.

Referring now to FIG. 1, the electrode arm 1 is movable above an electric smelting furnace in a vertical plane. On the front side of arm 1, the fixed contact jaw 2 is provided which is connected to a power supply line 3 and transfers the power to a graphite electrode 4. The electrode is supported by a displaceable electrode holder jaw 5 and pressed by a clamping jaw 6 of the holder firmly into contact with the contact surface of contact jaw 2. Electrode jaw 5 is supported in the electrode arm and provided with a forked head 7 for receiving a connecting rod 8. The end of rod 8 carries the pretensioned spring 9 producing a contact pressure for the graphite electrode.

To insert or displace electrode 4, the movable clamping jaw 6 is disengaged from electrode by further compressing spring 9 by means of hydraulic cylinder 10, through an opening distance. The pressure fluid for operating hydraulic cylinder 10 is supplied from a hydraulic set generally designated 11 which is a compact unit and includes a supply tank 11*a*, an electric motor 11*b*, a pump 11*c*, and controls and connections 11*d*. The compact unit 11 is supported within electrode arm 1 on elastic, vibration absorbing members 12. In addition, all the connecting elements are completely insulated electrically.

To provide shielding against magnetic fields of the power supply for the electrode, the compartment for the hydraulic unit is closed on all sides, except for the area of connecting a tube 13 through which air is supplied to motor 11, and in which the power supply cable for the unit is accommodated, and lined with a dielectric material. The access opening to the compartment is closed by a water-cooled cover 16.

In greater detail, the forked arm 7 and connecting rod 8 is mounted for sliding movement within electrode arm 1 on journal surfaces 20 shown schematically. Electrode jaw 5 includes a portion which extends around the graphite electrode 4 and connects to the forked arm 7 to engage connecting rod 8. In this fashion, clamping jaw 2 can slide horizontally as seen in FIG. 1 either to the left under the influence of spring 9 to clamp graphite electrode 4 or to the right under the influence of hydraulic cylinder 10 to unclamp graphite electrode 4.

Clamping jaw 5 is defined with a chamber 5*a* therein which receives circulating coolants for cooling the jaw 5.

The fixed jaw is connected to a bulkhead 50 at the front end of the electrode arm 1.

Connecting rod 8 is connected to a piston rod 10*a* of cylinder 10 and includes a ring 10*b* which bears against spring 9. Spring 9 also bears against one side of a bulkhead 28 to force connecting rod 8 to the left as seen in FIG. 1 to forcefully clamp the electrode 4. Connecting rod 10 extends through bulkhead 28 to connect with forked arm 7.

The hydraulic cylinder is connected to a bulkhead 26. The hydraulic set 11 is mounted within an enclosured portion of electrode arm 10 defined by bulkheads 22 and 24. The connection 11*d* extends between bulkheads 22 and 26. An access door 36 is provided over the compartment containing hydraulic cylinder 10.

The hydraulic set 11 is mounted by mounting means including the elastic mounts 11, to brackets or supports 32 and 34 connected to bulkheads 22 and 24, respectively. The hydraulic set is mounted as a unit with tank 11*a* connected mechanically to motor 11*b* and pump 11*c*.

Cover 16 includes a shell portion 16*a* which forms a chamber 16*b* to contain flowing coolant to cool the cover and the electrode arm. Air tube 13 extends through bulkhead 24.

Figure 2:
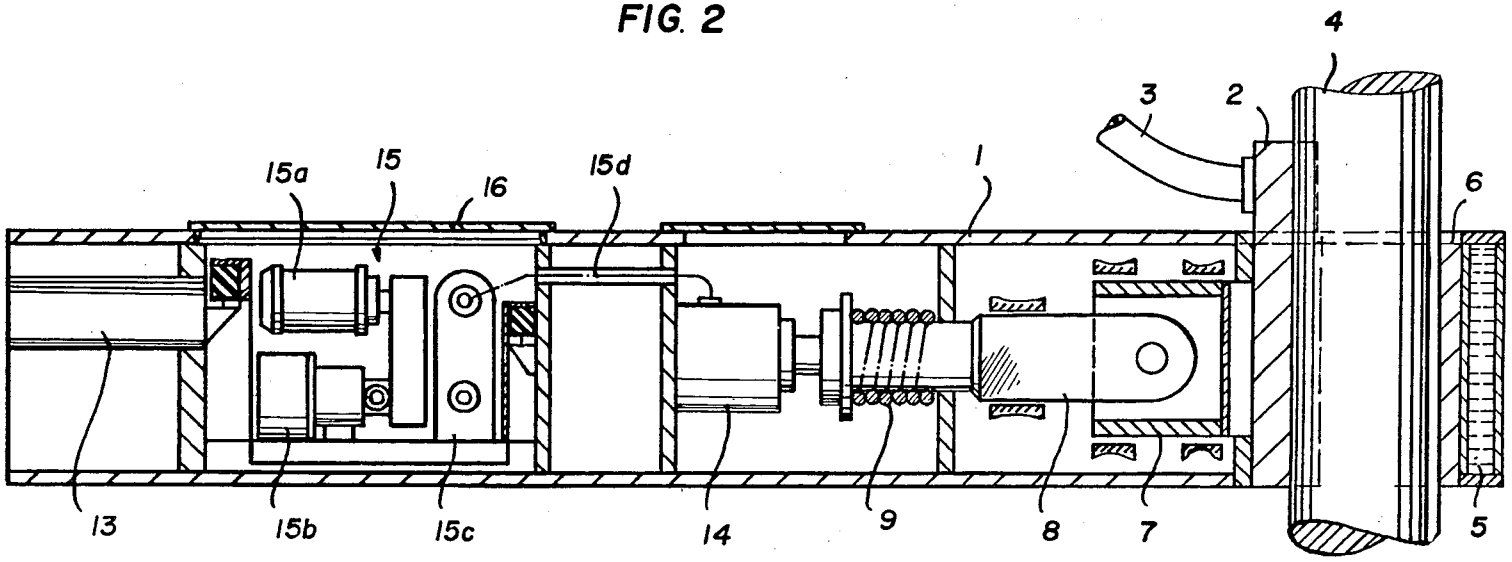
FIG. 2 is a view similar to FIG. 1 of an alternate embodiment of the invention using a pneumatic scheme.

In FIG. 2, like numerals are used to designate similar features of the invention.

The electrode arm 1 shown in FIG. 2 is equipped with a pneumatically operated mechanism for opening electrode holder or jaw 5. The design is similar to that with a hydraulic mechanism. During the opening operation, spring 9 is actuated by the piston of a pneumatic cylinder 14. Unit 15 produces the necessary air pressure and includes an electric motor 15*a*, a compressor 15*b*, a pressure tank 15*c*, controls, and flexible connecting tubes 15*d*. The unit is again mounted in a shielded compartment with an air supply conduit 13, on supports which absorb vibrations and are electrically insulating.

While specific embodiments of the invention have been shown and described in detail to illustrate the application of the principles of the invention, it will be understood that the invention may be embodied otherwise without departing from such principles.

What is claimed is:

1. In an electrode holder including, an electrode arm, a fixed contact connected to an end of said arm, a movable electrode jaw movably mounted to said arm and having a clamping contact, and biasing spring means connected to the electrode jaw for moving the clamping contact toward the fixed contact to clamp an electrode therebetween, the improvement comprising: fluid pressure means in said arm and connected to said electrode jaw for acting to counter the force of said biasing means when fluid under pressure is supplied to said fluid pressure means; and fluid motor means mounted as a unit in said arm and connected to said fluid pressure means for supplying fluid under pressure to said fluid pressure means whereby an electrode can be released from between said fixed and clamping contacts.

2. The improvement of claim 1, wherein said fluid pressure means comprises a piston-cylinder combination connected to said electrode jaw, said fluid motor means comprising an electric motor, a pump connected to said electric motor, a reservoir for containing fluid connected to said pump and a connecting tube connected between said reservoir and pump and said cylinder piston combination, said motor, pump and reservoir mounted as a unit in said electrode arm.

3. An improvement according to claim 2, including elastic mounting means connected between said motor, pump and reservoir unit and said electrode arm.

4. An improvement according to claim 2, including at least two bulkheads in said electrode arm defining a shielded compartment in said electrode arm, said motor, pump and reservoir unit mounted in said shielded compartment.

5. An improvement according to claim 2, wherein said cylinder-piston combination is supplied with hydraulic fluid, said connecting tube comprising a flexible hydraulic line connected between said pump and said hydraulic cylinder-piston combination.

6. An improvement according to claim 2, wherein said cylinder and piston combination receives pneumatic fluid, said connecting tube comprising a flexible pneumatic tube connected between said reservoir which contains pneumatic fluid and said pneumatic cylinder and piston combination.

7. The improvement according to claim 2, wherein said electrode arm includes means defining a compartment which is lined with non-magnetic and dielectric material for shielding said compartment, said motor, pump and reservoir unit mounted in said compartment, and an elastic member connected between said motor, pump and reservoir unit and said means defining said compartment for absorbing and insulating the vibrations of said electrode arm.

8. An improvement according to claim 7, including an opening through said electrode arm communicating with said compartment and a cover member over said opening covering said compartment.

9. An improvement according to claim 8, wherein said cover includes a chamber for receiving coolant for cooling said cover.

10. An improvement according to claim 2, including a forked arm connected to said electrode jaw slidably mounted in said electrode arm, a connecting rod connected between a piston of said cylinder and piston combination and said forked arm, a bulkhead in said electrode slidably receiving said connecting rod, a ring connected to said connecting rod, said biasing spring means comprising a pretensioned compression spring mounted between said ring and said bulkhead for biasing said electrode jaw toward said fixed contact.

11. An improvement according to claim 4, wherein one of said bulkheads has an opening therein, and an air tube connected to said opening for supplying said compartment with air.

* * * * *